United States Patent [19]

Maletic

[11] Patent Number: 4,940,358

[45] Date of Patent: Jul. 10, 1990

[54] TEXTURING DEVICE FOR WET CONCRETE

[76] Inventor: Victor A. Maletic, 3330 Meadowbrook Rd., Antioch, Calif. 94509

[21] Appl. No.: 290,026

[22] Filed: Dec. 27, 1988

Related U.S. Application Data

[63] Continuation-in-part of Ser. No. 128,909, Dec. 12, 1987, abandoned.

[51] Int. Cl.[5] ..... E01C 19/43

[52] U.S. Cl. ..... 404/93; 404/118; 56/400.21

[58] Field of Search ..... 404/93, 97, 118, 89; 425/63, 385; 172/532; 56/400.01, 400.16, 400.17, 400.21

[56] References Cited

U.S. PATENT DOCUMENTS

| | | | |
|---|---|---|---|
| 3,703,857 | 11/1972 | Mackinnon | 404/93 |
| 3,775,018 | 11/1973 | Barton | 404/93 |
| 4,318,631 | 3/1982 | Vickers | 404/93 |
| 4,743,140 | 5/1988 | Maletic | 404/93 X |

*Primary Examiner*—Jerome W. Massie
*Assistant Examiner*—Matthew Smith
*Attorney, Agent, or Firm*—Bielen, Peterson & Lampe

[57] ABSTRACT

A device for texturing the surface of freshly poured concrete utilizing a platform having first and second surfaces. A plurality of loops are spaced along and extend from the first surface of the platform. The plurality of loops are resiliently and detachably connected to the platform for movement with the platform.

8 Claims, 7 Drawing Sheets

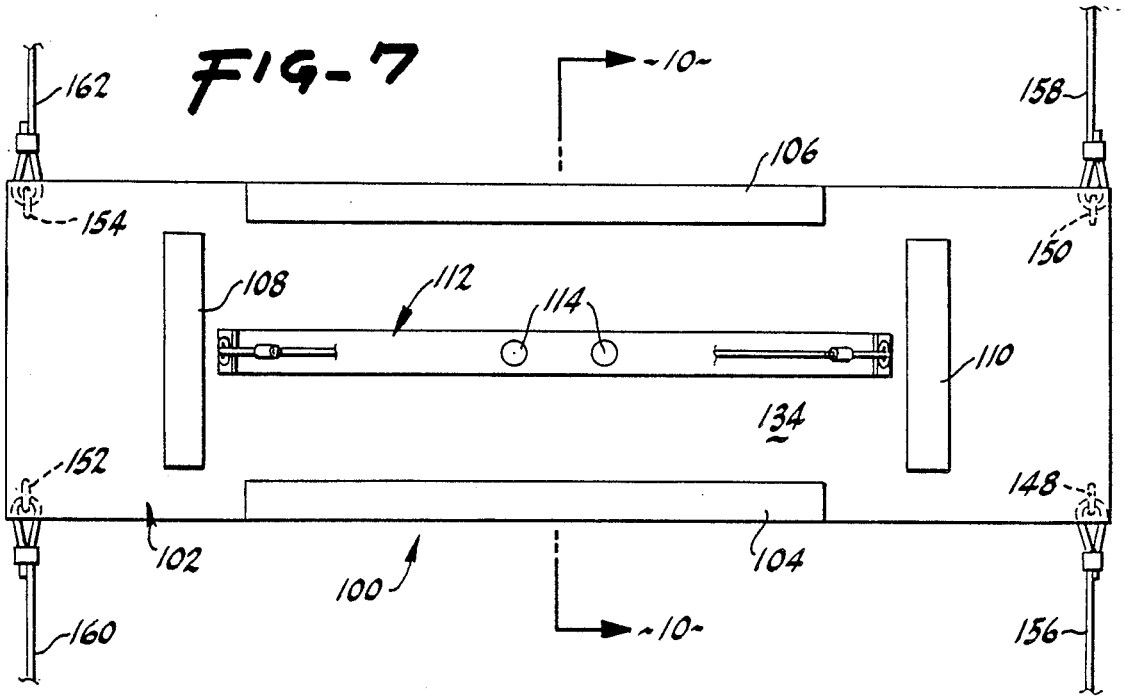
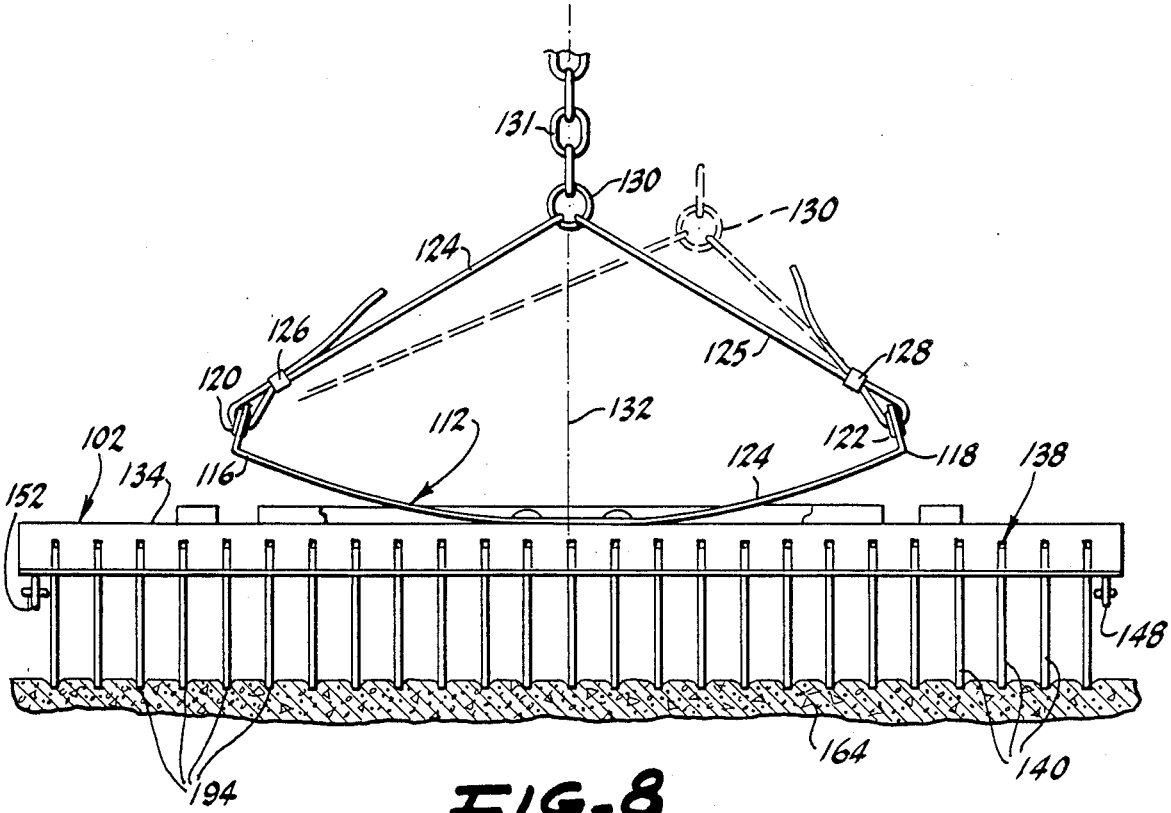
FIG-8

TEXTURING DEVICE FOR WET CONCRETE

CROSS-REFERENCES TO RELATED APPLICATIONS

The present application is a continuation-in-part of Ser. No. 127,909; filed Dec. 2, 1987 , abandoned.

BACKGROUND OF THE INVENTION

The present invention relates to a novel device for texturing the surface of freshly poured concrete.

Concrete employed for roadways and bridges require texturing such that a multiplicity of grooves or striations are formed on the surface of the concrete intended for frictionally contacting vehicle tires. Governmental authorities require vehicular concrete surfaces to meet a certain coefficient of friction test. Initially freshly poured concrete may often meet the coefficient or friction test without texturing. However, after a number of years a vehicular concrete surface may become smooth and fail the same test. Therefore, it is important to texture freshly concrete to insure that a vehicular roadway will possess a requisite degree of roughness over long periods of time e.g. 30 to 50 years.

In the past, mats or sacks of fibrous material have been dragged over freshly poured concrete in this regard. However, an inconsistently textured surface often result and these materials lack durability. Brooms have often been employed for the same purpose but tend to produce a surface texture that is too coarse. In addition, brooms tend to pull aggregate from the freshly poured concrete and scatter the same over the surface of the concrete. Brooming also requires the provision of walkways for the persons using the same which is quite expensive and time consuming. Tining forks may also be pulled across freshly poured concrete but, again, aggregate is dislodged and a very rough surface results.

Complicating the process of texturing is the fact that freshly poured concrete differs in consistency as a result of the manufacturing process, the moisture content of the mixture components, and the weather conditions existing during the pouring of the concrete. Modern paving techniques call for the use of paving carriage finishers which automatically pour, strike and float the concrete. Texturing should be incorporated into the use of carriage finishers to increase the efficiency of paving work.

A texturing device that solves the problems noted in the prior art will be a great advance in the art of surface paving.

SUMMARY OF THE INVENTION

In accordance with the present invention a novel and useful device for texturing of the surface of freshly poured concrete is provided.

The device of the present invention employs a platform which has a first surface and a second surface. The platform may be formed of any rigid or semi-rigid material., A plurality of loops are also used and are connected to the platform in spaced relationship with the first surface of the platform. The loops are connected to the platform so that the loops and the platform generally move together over the surface of the concrete.

The plurality of loops may include a single or double helical member which extends along the surface of the platform. The helical member may be constructed to possess flexibility along its axis. In addition, the helical member or members may pivot about the connection means along the line of travel of the texturing device.

The connecting means may include a rod which fixes to the platform and extends through the helical member or members. Thus, the helical member may move transversely to the direction of travel of the texturing device. Moreover, the resiliency possessed by the helical member or members permits movement or deformation throughout a plane which is perpendicular to the direction of travel of the texturing device. Finally, there may be movement between successive loops of the helical member or members. The rod holding the helical member to the platform may be provided with stops to restrict relative movement between the helical member or members connected the platform along the line of the travel of the texturing device.

The platform may be constructed also to hold a mass of material on the second surface to exert a normal force on the helical member or members below. For example, concrete may be placed on the second surface of the platform.

The texturing device of the present invention may include means for linking the same to a kinetic source i.e. a carriage finisher. Thus, a texturing device hereindescribed may be directly connected to the carriage finisher such that texturing takes place immediately after striking and floating of the concrete.

In another embodiment, the present invention may include a plurality of loops that are detachably supported to the first side of the platform. The detachable rings may include grooves or recesses that snap into a member fastened to the platform. Channels are formed in another member fastened to the platform to guide or laterally support the plurality of loops to the platform.

A further aspect of the present invention may be found in the provision of means for adjusting the downward pressure of the loop on the soft concrete. Such means may externalize in a spring member fastened to the platform, and means for pulling the spring member outwardly relative to the platform.

Another embodiment of the present application utilizes a plurality of open loop members resiliently affixed to a platform.

It may be apparent that a novel and useful concrete texturing device has been described.

It is therefore an object of the present invention to provide a device for texturing the surface of freshly poured concrete which is compatible with carriage finishing machines.

Another object of the present invention is to provide a device for texturing the surface of freshly poured concrete which is compatible with aggregate used in the concrete in that aggregate is not dislodged and carried across the surface of the concrete, at any time during the texturing process.

It is yet another object of the present invention to provide a device for texturing the surface of freshly poured concrete which is usable with concrete in various stages of softness and hardness.

A further object of the present invention is to provide a device for texturing the surface of freshly poured concrete which is compatible with various types of concrete including air entrained concrete, steel fiber reinforced concrete, and the like.

Yet another object of the present invention is to provide a device for texturing the surface of freshly poured concrete which is economical to manufacture and efficiently performs the texturing task.

Another object of the present invention is to provide a device for texturing the surface of freshly poured concrete which includes replaceable parts to facilitate maintenance of the device.

Another object of the present invention is to provide a device for texturing the surface of freshly poured concrete which provides a variety of grooved spacing patterns.

Still another object of the present invention is to provide a device for texturing the surface of freshly poured concrete which includes a plurality of removable loop members resiliently held to a platform.

A further object of the present invention is to provide a device for texturing the surface of freshly poured concrete which includes a platform capable of carrying weight at a relatively low center of gravity.

The invention possesses other objects and advantages especially as concerns particular characteristics and features thereof which will be apparent as the specification continues.

BRIEF DESCRIPTION OF THE DRAWINGS

FIG. 7 a top plan view of another embodiment of the present invention.

FIG. 8 is side view of the embodiment of the invention depicted in FIG. 7.

Figure 1:
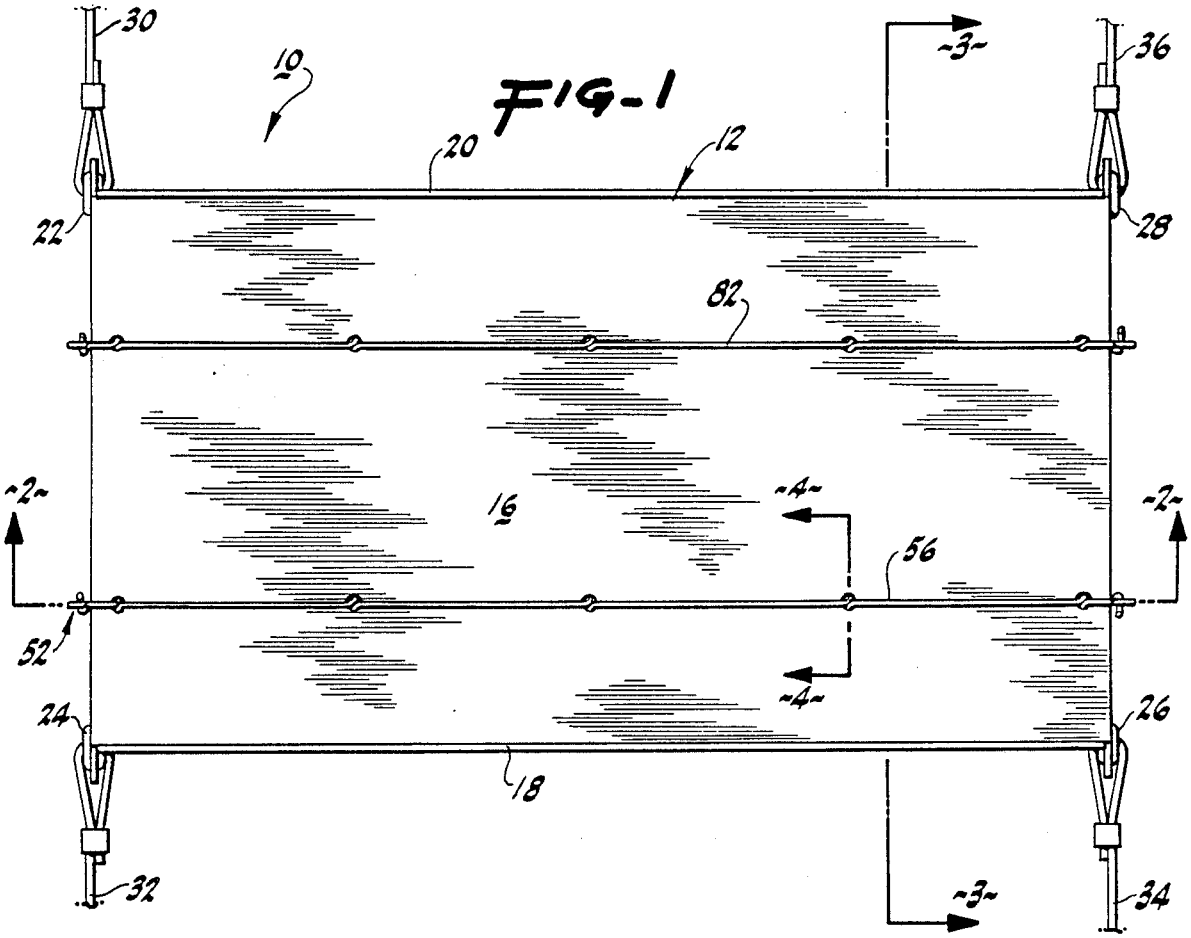
FIG. 1 is a top plan view of the texturing device of the present invention.

For a better understanding of the invention reference is made to the following description of the preferred embodiments which should be referenced to the hereinabove drawings.

DESCRIPTION OF THE PREFERRED EMBODIMENTS

Various aspects of the present invention will evolve from the following detailed description of the preferred embodiments which will be referenced to the hereinabove drawings.

The invention as a whole is designated in the drawings by reference character 10. The concrete texturing device 10 includes as one of its elements a platform 12 having a first lower surface 14 and a second upper surface 16. Shoulders 18 and 20 extend upwardly from surface 16 along two sides of platform 12. Although platform 12 is shown as being rectangular in plan view and planar, it should be understood that platform 12 may take other shapes such as circular in plan view, cup-shaped, and the like. Grommet 22, 24, 26 and 28 serve as anchoring points for lines 30, 32, 34 and 36, the purpose of which will be described hereinafter.

Figure 2:
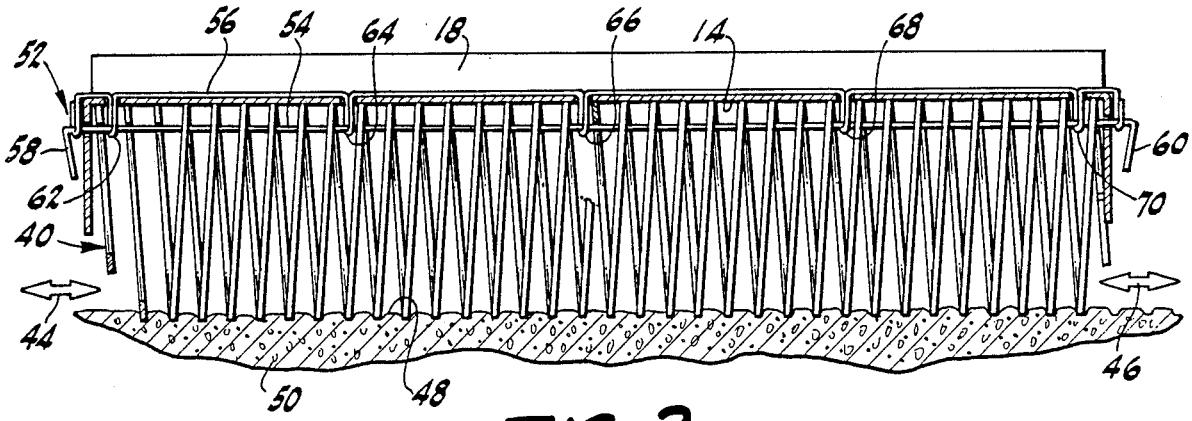
FIG. 2 is a sectional view taken along line 2—2 of FIG. showing a portion of a concrete surface being textured.

Turning to FIG. 2 it may be seen that a plurality of loops are spaced along and extend outwardly from first surface 14 of platform. As depicted in the preferred embodiments in the drawings. Plurality of loops 38 may take the form of helical members 40 and 42, best shown in FIGS. 2, 3, and 6. With reference to FIG. 2 it may be seen that helical member 40 is illustrated and is substantially identical to adjoining or adjacent helical member 42. Helical member 40 possesses the properties of a coil spring. Member 40 may constructed of any material exhibiting these properties and is preferably formed of PVC (polyvinylcholoride) plastic. Thus, there is flexibility between successive coils of helical member 40 according to directional arrows 44 and 46. In other words, the coils or loops of helical member 40 move along axis 46 of helical member 40. This axial movement is especially acute at the point of contact between the coils of helical member 40 and the surface 48 of soft concrete pour 50.

Means 52 connects plurality of loops 38 to platform 12. Means 52 externalizes in the embodiment shown as a rod 54 which extends along first surface 14 of platform 12 and in spaced relationship therewith. Rod 54 is held in position by wire 56 which wraps around the end portion 58 and 60 of rod 54 and encircles rod 54 along it span beneath first surface 14 of platform 14. These encirclements 62, 64, 66, 68, and 70 also forms stops in the travel of helical member 40.

Figure 4:
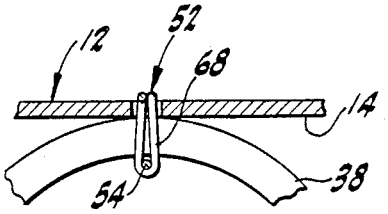
FIG. 4 is an enlarged partial sectional view taken generally along line 4—4 of FIG. 1.
Figure 5:
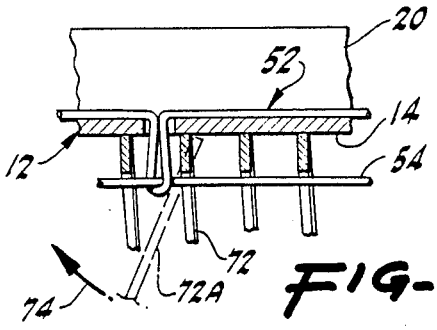
FIG. 5 is an enlarged sectional view of the upper portion of FIG. 2.

Turning to FIGS. 4 and 5, encirclement 68 is depicted. FIG. 5 illustrates the pivoting of a loop 72 such as loop 72A when stop or encirclement 68 is contacted by the upper portion of loop 72. Thus, plurality of loops 38 also pivot generally in the plane through rod 54 and perpendicular to platform 12, directional arrow 74.

Figure 3:
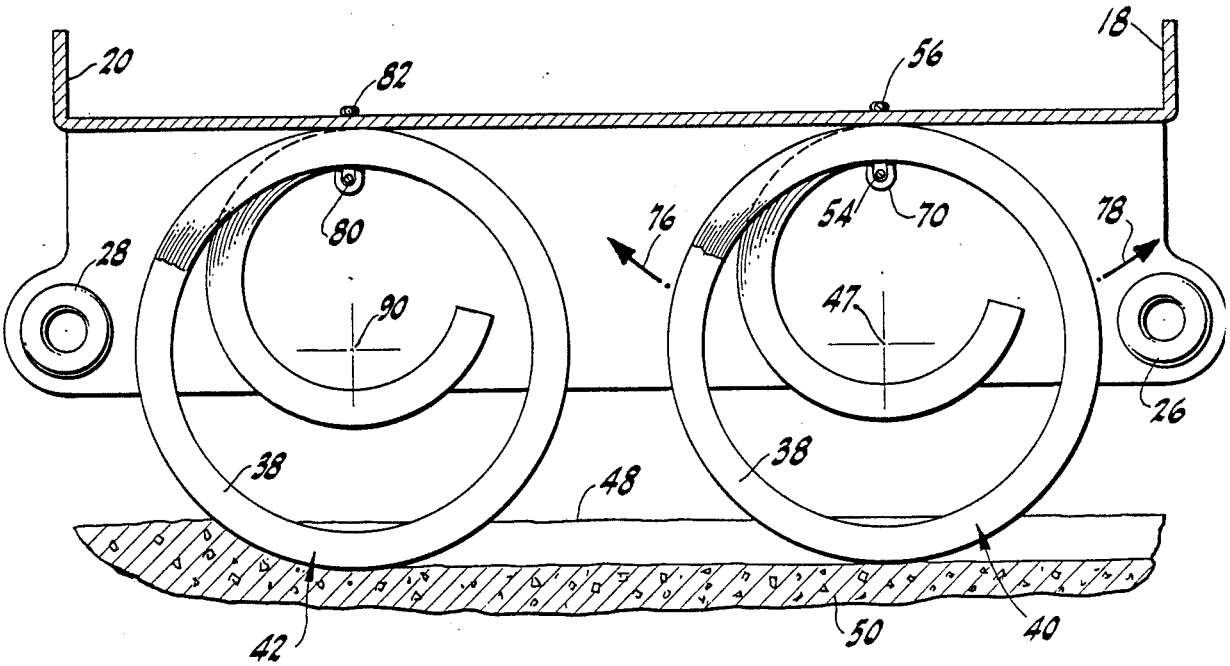
FIG. 3 a sectional view taken along line 3—3 of FIG. 1.

Turning to FIG. 3 it may be seen that helical member 40 is able to pivot according to directional arrows 76 and 78 i.e. in planes that are perpendicular to rod 54. Of course the above description in reference to helical member 40 also applies to helical member 42 which includes a rod 80 and wire 82. The connection of the helical member 42 to platform 12 is identical to that of helical member 40 and no further details will be given therewith for the sake of brevity.

Figure 6:
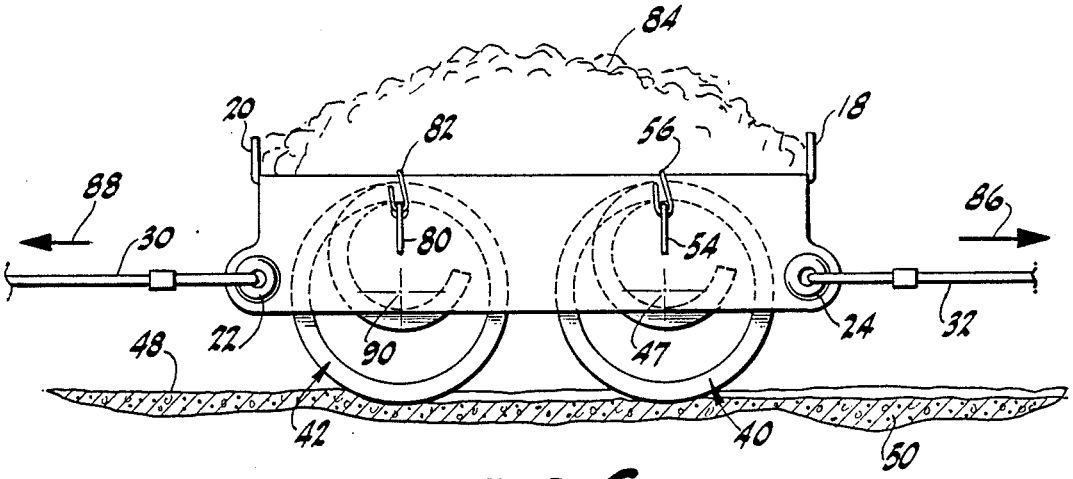
FIG. 6 an end view of the device being moved across a soft concrete surfaces.

The texturing device 12 is also provided with means for confining a selected mass of material such as concrete mass 84, FIG. 6, to second surface 16 of platform 12. Of course, other objects having mass may be used in place of concrete mass 84.

With reference to FIG. 7 it may be seen another embodiment 100 of the present invention is shown which includes a platform 102 having stringers 104, 106, 108, and 110 fastened to platform 102. Leaf spring 112 is fastened to platform 102 by screws 114. Leaf spring 114 possesses free ends 116 and 118 with eyes 120 and 122. Lines 124 and 126 are fastened to eyes 120 and 122 respectively by adjustable fittings 126 and 128. Thus, the length of line 124 and/or 126 may be adjusted such that ring 130 is movable from vertical axis 132 (shown in phantom in FIG. 8). Thus, the downward force of platform 102 may be biased to one end of thereof. Platform 102 includes a first or upper surface 134 and a lower surface 136.

Figure 9:
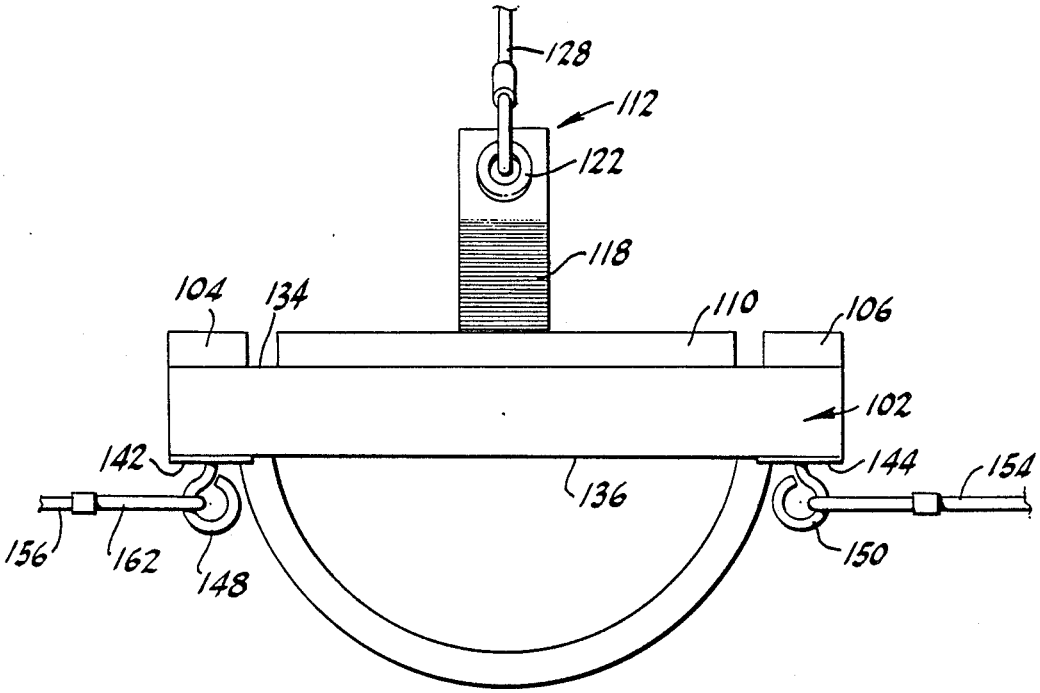
FIG. 9 is a right end view of the embodiment of the invention depicted in FIG. 7.

With reference to FIG. 8 it may be seen that platform 102 includes a plurality of grooves 138 each capable of holding a loop of a plurality of loops 140 each having a roughly semi-circular configuration. With reference to FIG. 9 it may be seen that platform lower surface 136 has a pair of plates 142 and 144 mounted thereto by plurality of fasteners 146. Plates 142 and 144 serve as an anchoring strip for eyes 148, 150, 152, and 154. These eyes serve as terminals for lines 156, 158, 160 and 162 which are employed to drag device 100 across freshly poured concrete 164, FIG. 8.

Figure 10:
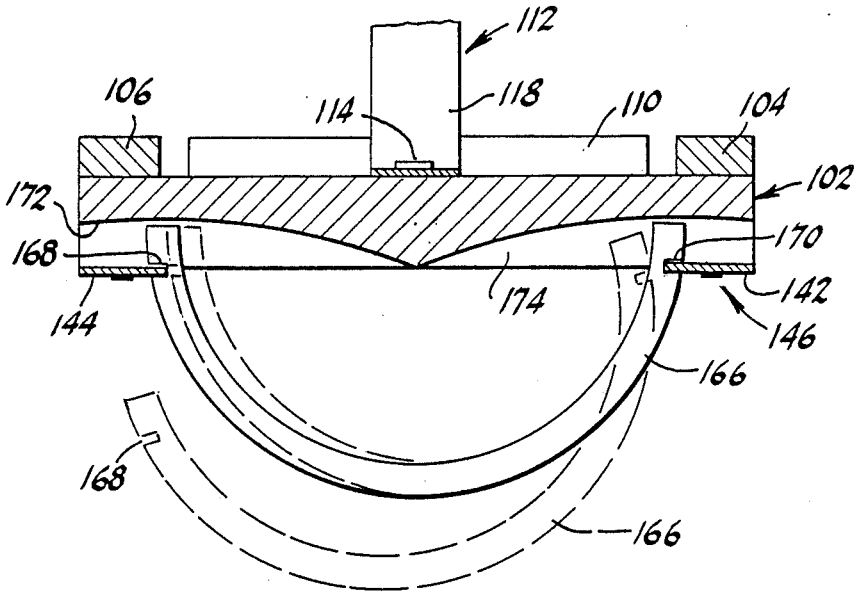
FIG. 10 is a sectional view taken along line 10—10 of FIG. having a phantom illustration of alternate positions of a removable
Figure 11:
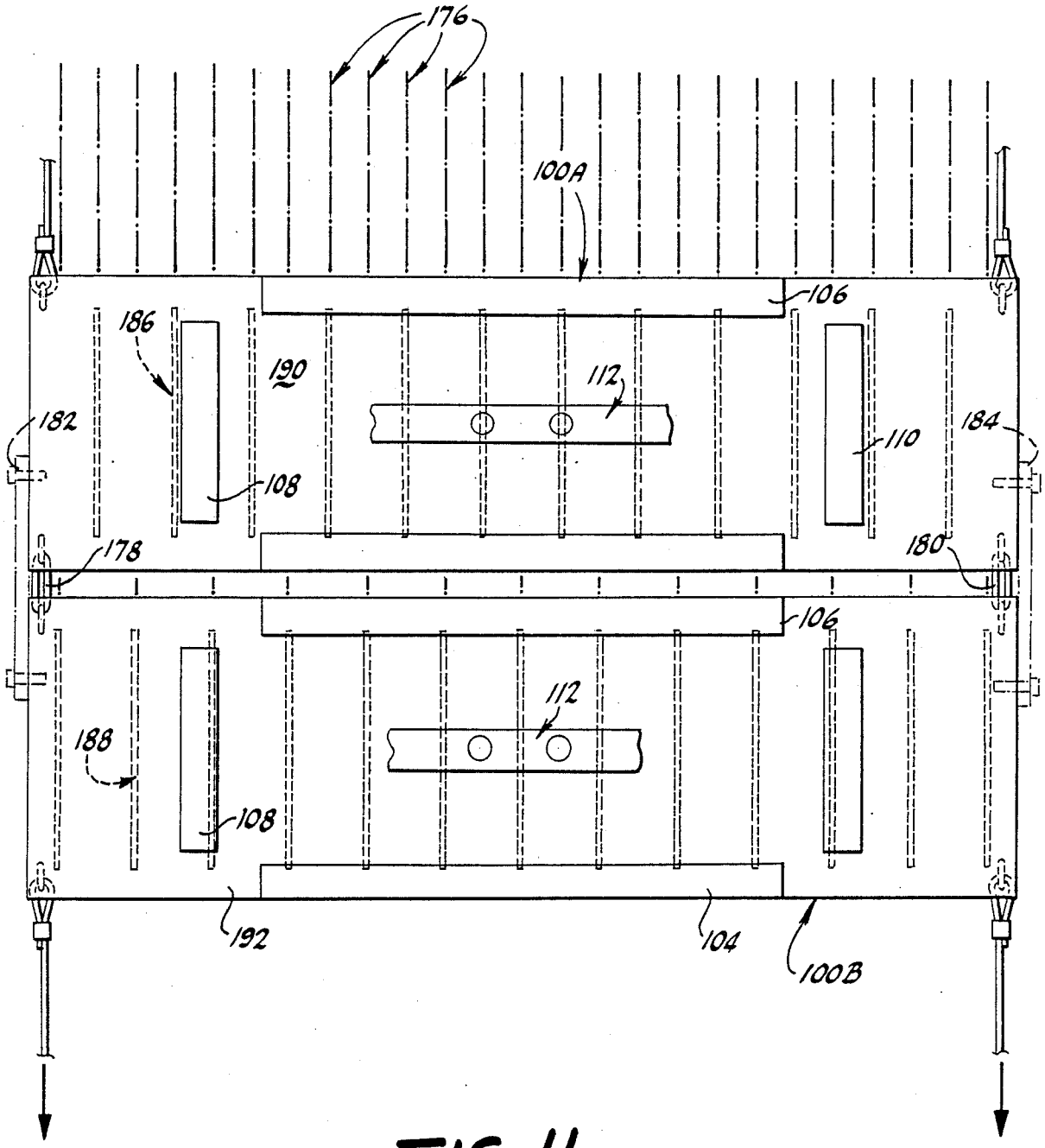
FIG. 11 is a top plan view of a tandum arrangement of a pair of devices shown in FIG. 7—7.

With reference to FIG. 10 it may observed that plates 144 and 142 also serve to hold plurality of loops 140 to the bottom surface 136 of platform 102. Loop 166 is illustrated as having a pair of notches 168 and 170 which fits over plates 142 and 144. Loop 146, as well as plurality of loops 140, are relatively flexible in this regard, being easily removed and placed within plurality of grooves 138 and against plates 142 and 144. Loop 166 is shown within grooves 172 and 174 in FIG. 10. With reference to FIG. 11 it ma be seen that a pair of devices 1OOA and 1OOB have been fastened together for dragging across the freshly poured concrete 164 and producing plurality of score cavities 176 therein. Devices 1OOA and 1OOB may be fastened by links 178 and 180, or by straps 182 or 184. It should be noted that straps 182 and/or 184 may be rigid, semi-rigid, or flexible members. Importantly, the plurality of loops 186 of device plurality of loops 186 of device 1OOA and plurality of loops 188 of device 1OOB are fixed in non-alignment. In other words, the spacing of plurality of loops 186 and 188 is double the spacing of loops 140 shown in FIG. 8. In this pattern, plurality of loops 186 and 188 occupy alternate grooves on the lower surface of the platforms 190 and 192 of devices 100A and 1OOB respectively. The consecutive score cavities 176 produced by the tandem arrangement of devices 1OOA and 1OOB, thus, are alternately produced by devices 1OOA and 1OOB. The larger spacing of plurality of loops 186 and 188 in devices 1OOA and 100B accommodates large aggregate, fibers, or the like found in freshly poured concrete. Consequently, fowling of devices 1OOA and 100B by such particulate matter is avoided and scoring pattern 176 is produced which is similar to the scoring pattern 194 produced by device 100, FIG. 1.

With reference to FIGS. 12–15, another embodiment 200 of the present invention is depicted. Embodiment 200 includes a platform 202 having a first bottom surface 204 and a second upper surface 206. Upper surface 206 is formed with a cavity or depression 208 which is intended for holding a mass, such as wet concrete mass 210. Again, embodiment 200 includes a plurality of loops 212, best shown in FIG. 12, including a typical loop 214 depicted in FIG. 13. It should be noted that depression or cavity 208 extends downwardly into plurality of loops 212 to provide embodiment 200 with a relatively low center of gravity in operation. Again, loop 214 includes end portions 216 and 218 with an intermediate portion 220 intended for scoring the surface of freshly poured concrete 164.

Holding means 222 is also provided for indivually and resiliently detachably connecting each of the plurality of loops 212 to platform 202. Means 222 includes springs 224 and 226 which are extended along the length of platform 202, best illustrated in FIG. 14. Platform 202 terminates in horizontal members 228 an 230 which lie adjacent spring members 224 and 226, FIGS. 13 and 15. As depicted in FIG. 15 with respect to loop 232 each loop of plurality of loops 212 includes notches similar to notches 234 an 236 which fit into members 228 and 230. It should also be noted, that the ends of loop 232 fit in between the turns of coil springs 224 and 226. Thus, pluraltiy of loops 212 are resiliently confined to members 228 and 230 between springs 224 and 226. In other words, loops 212 would be free to slide along members 234 and 236, were it not for springs 224 and 226. Such movement would generally be transverse to the movement of platform 202.

Figure 13:
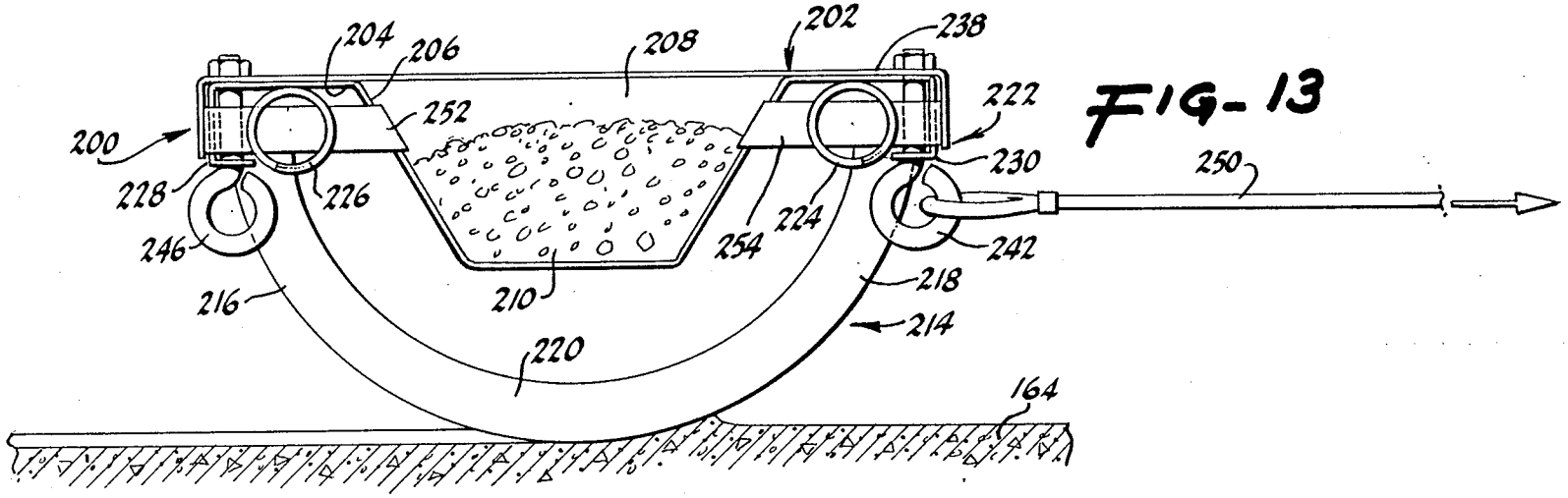
FIG. 13 is a partial sectional view taken along line 13—13 of FIG. 12.
Figure 12:
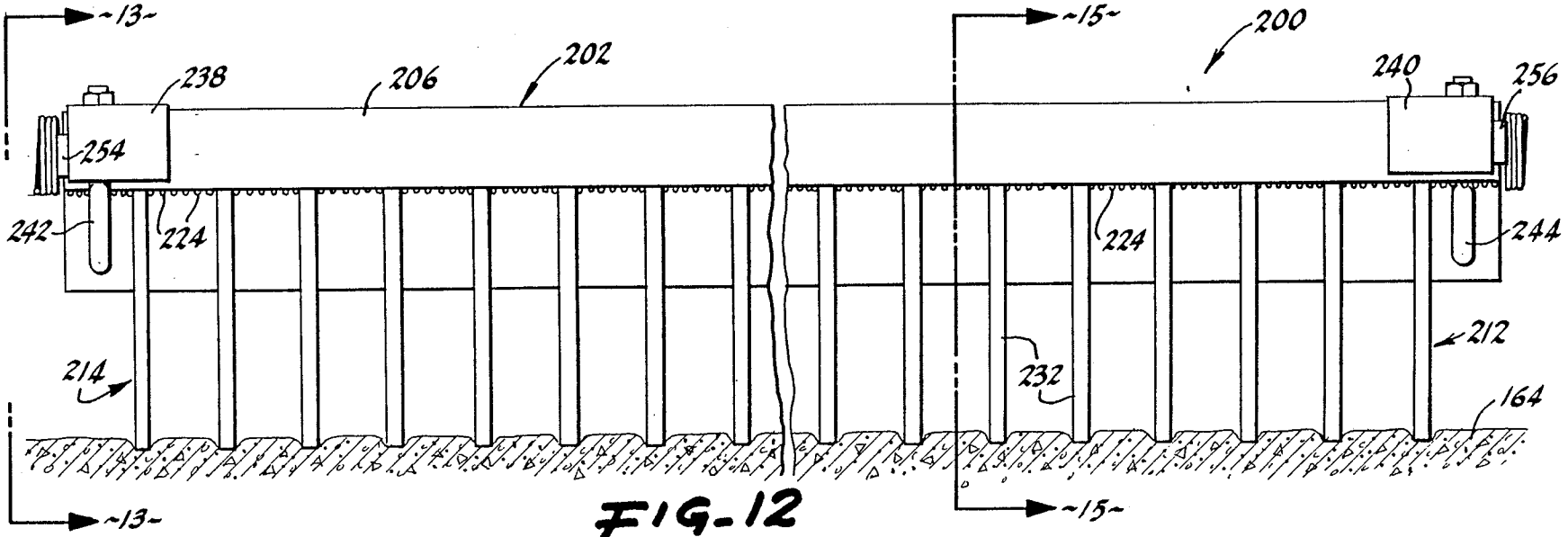
FIG. 12 is a broken front elevational view of another embodiment of the present invention.

Caps 238 and 240 extend along the ends of platform 202 and are affixed thereto by threaded eyes 242, 244, 246, and 248 each having a retaining nut. As noted in the described embodiments, eyes 242, 244, 246 and 248 also serve as fastening points for lines dragging embodiment 200 over freshly poured concrete 164. A typical line 250 is depicted in FIG. 13, in this regard. A quartet of retainers or clips 252, 254, 256, and 258 hold springs 224 and 226 in place. Retainers 252, 254, 256 and 258 may be fixed by gluing or welding the same to caps 238 and 240, although this is not necessary since the compression action of springs 224 and 226 would naturally hold retainers 252, 254, 256 and 258 in place.

Figure 14:
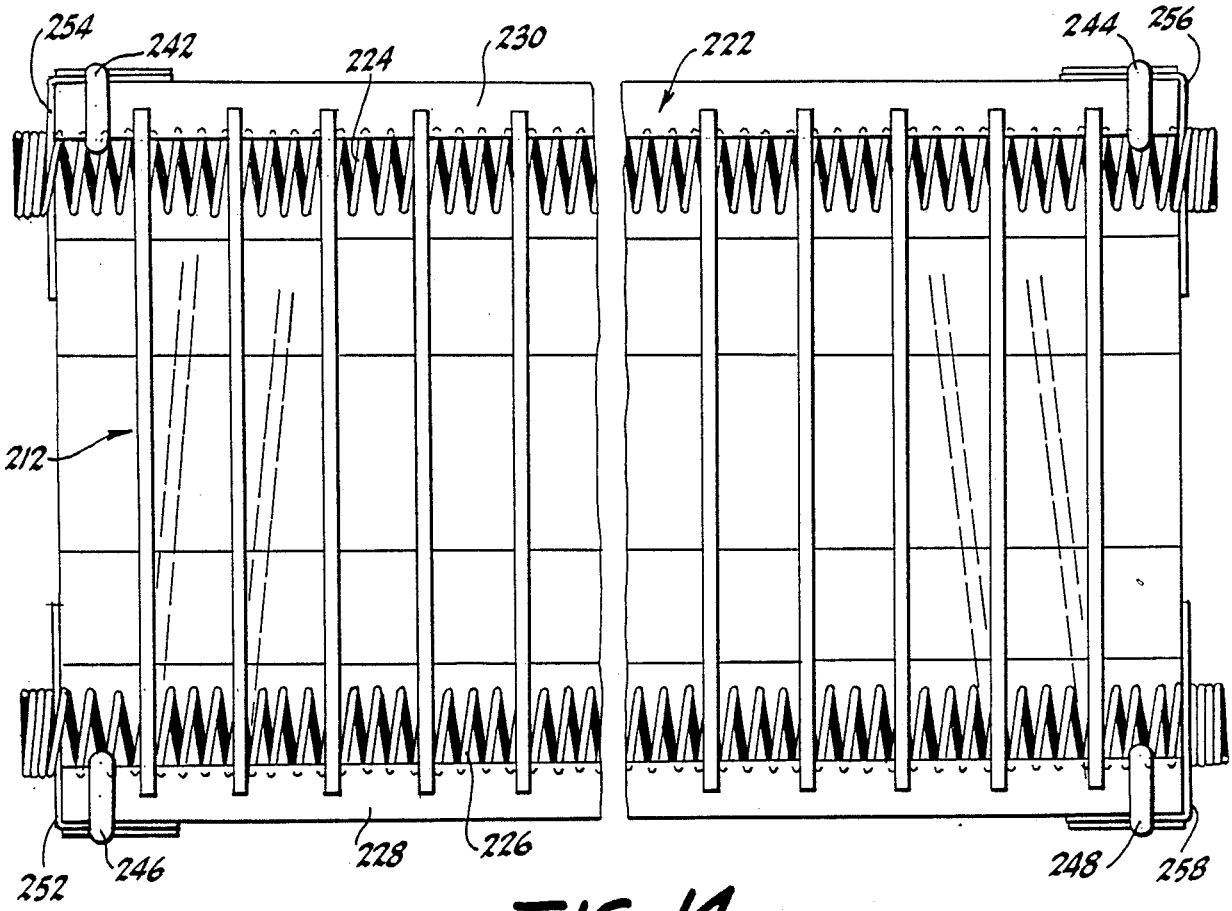
FIG. 14 is a broken bottom plan view of the embodiment shown in FIG. 12.
Figure 15:
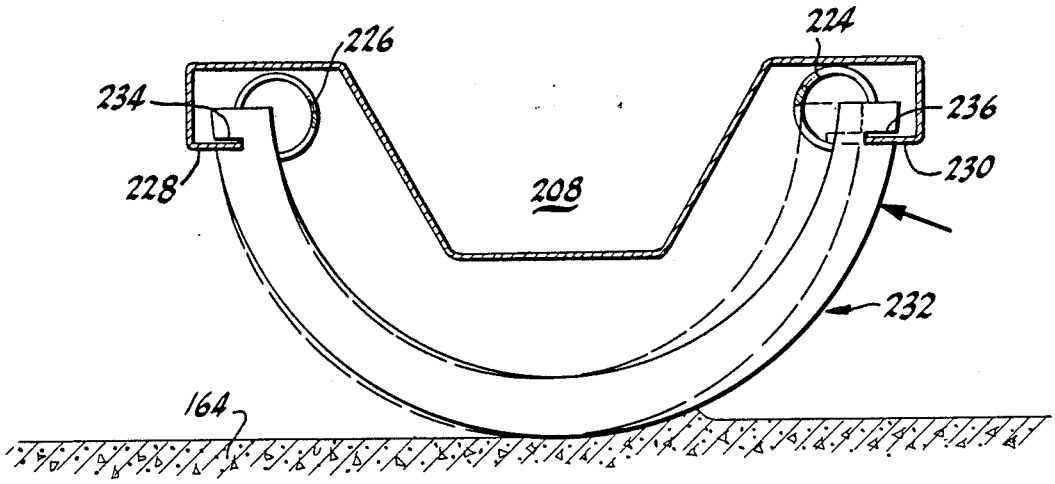
FIG. 15 is a sectional view taken along line 15—15 of FIG. 12.

As depicted in FIGS. 14 and 15, plurality of loops 212 are resilient and may be placed in position between springs 224 and 226 along members 234 and 236. Also, as depicted in phantom in FIG. 14, the intermediate portions (such as portion 220 of loop 214) plurality of loops may move if resistance is met on poured concrete 164. Also, each loop could slide on members 234 and 236. Again, loops 212 would move back into the position shown in solid lines in FIG. 14 by the action of spring members 224 and 226 after passing the obstruction on concrete 164.

In operation, the user connects lines 30, 32, 34 and 36 to the kinetic source (not shown) which would drag device 10 across surface 48 of concrete pour 50 according to directional arrows 86 and 88, FIG. 6. Plurality of loops 38 in the form of helical members 40 and 42 will score or groove the surface 48 of concrete pour 50, best shown in FIG. 2. In addition, due to the resilient or flexible characteristics of helical members 40 or 42, heretofore described, helical members will compress or expand along axes 46 and 90. The ability to give when a force is applied to plurality of loops 38 renders device 10 compatible with any concrete materials, especially those having large objects such as aggregate, metal fibre, and the like. Device 10 may be connected to a carriage finisher and thus be dragged back and forth over pour 50 immediately after striking off of the concrete. Any variation in the softness or hardness of, the concrete pour 50 may be compensated for by placing a predetermined mass such as concrete mass 84 on the second surface 14 of platform 12.

The embodiments shown in FIGS. 7–11 may also be employed in a similar manner to score freshly poured concrete. Device 100 is dragged across freshly poured concrete 164 by the us of lines 156, 158, 160, and 162. A scoring pattern 192 is produced thereby. Spring 124 may be lifted from concrete 164 by pulling ring 130 with chain links 131. This pulling of ring 130 adjusts the downward pressure on concrete 164. Such pressure may be offset by moving ring 130 away from axis 132, FIG. 8. For example, if spring 112 exhibits unsymmetrical force, ring 130 may be moved as shown in FIG. 8 to compensate for this factor and allow platform 134 to remain generally in a plane parallel to the surface of concrete 164. Plurality of rings 140 may be replaced or initially removed to provide a scoring pattern having different spacing between score cavities. This feature is specially useful when tandem devices 1OOA and 100B are employed which provides the scoring pattern 176 similar to scoring pattern 194 without permitting aggregate fibre or the like to foul the plurality of loops 186 and 188 of devices 1OOA or 1OOB.

The embodiment shown in FIGS. 12–15 may also be employed in a similar manner as the embodiments shown in FIGS. 7–11. Device 200 is dragged across freshly poured concrete in the same manner by the use of lines as prior described. However, spring members 224 and 226 resiliently permit the movement of loops 212 transversely relative to the direction of movement of device 200. Also, springs 224 and 226 are replaceable. In addition, the scoring pattern determined by the distance between plurality of loops 212 may be easily adjusted with device 200 by simply placing plurality of loops after a certain number of turns of each of the spring members 224 and 226.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A device for texturing the surface of freshly poured concrete used in conjunction with a kinetic source comprising:

a. a platform having a first surface and a second surface;

b. a plurality of open loops spaced along and extending outwardly from said platform first surface, each of said open loops having first and second ends, each of said open loops bearing on said platform and having a portion intermediate said first and second ends extending from said second surface of said platform, for contacting the freshly poured concrete beneath the platform, each of said plurality of open loops comprising a member possessing flexibility transversely relative to the freshly poured concrete; and c. holding means for individually and resiliently detachably connecting each of said plurality of loops to said platform for movement therewith to permit the loops to drag across the freshly poured concrete, said holding means including a resilient member extending along said platform and each of said plurality of loops including means for engaging said resilient members at a plurality of selected positions along said resilient member.

2. The device of claims 1 in which said resilient member includes a spring extending along said platform and each of said plurality of loops includes means for engaging said spring.

3. The device of claim 2 in which said means for engaging said spring comprises a first and a second member extending along said platform and supported by said platform, each of said plurality of loops including linking means for holding said loop to said first and second members.

4. The device of claim 3 in which said linking means includes a recess positioned adjacent said first and second ends of each of said plurality of loops.

5. The device of claim 2 in which said platform includes a depression extending into said plurality of open loops, said depression being capable of holding material.

6. The device of claim 1 which additionally comprises means for adjusting the downward pressure of said plurality of loops on the freshly poured concrete.

7. The device of claim 6 in which said means for adjusting the downward pressure of said plurality of loops includes a spring member fastened to said platform second surface and means for pulling said spring outwardly relative to the freshly poured concrete.

8. The device of claim 2 which additionally comprises a cap held to said platform, said cap at least partially surrounding said spring.

* * * * *